United States Patent [19]

Moen

[11] Patent Number: 4,457,342

[45] Date of Patent: Jul. 3, 1984

[54] HIGH RISE KITCHEN SPOUT

[75] Inventor: Alfred M. Moen, Grafton, Ohio

[73] Assignee: Stanadyne, Inc., Windsor, Conn.

[21] Appl. No.: 383,569

[22] Filed: Jun. 1, 1982

[51] Int. Cl.[3] ..... E03C 1/02

[52] U.S. Cl. ..... 137/801; 137/359; 137/615; 251/297; 4/192; 239/281

[58] Field of Search ..... 137/359, 615, 801; 251/297; 4/192; 285/302, 303, 318; 239/30, 281, 587

[56] References Cited

U.S. PATENT DOCUMENTS

| | | | |
|---|---|---|---|
| 1,054,572 | 2/1913 | Langley . | |
| 1,218,695 | 3/1917 | Phillips . | |
| 1,360,381 | 11/1920 | Edwards . | |
| 1,360,382 | 11/1920 | Edwards . | |
| 1,542,553 | 6/1925 | Hornbeck . | |
| 1,680,333 | 8/1928 | Kooperstein . | |
| 1,758,115 | 5/1930 | Kelly . | |
| 2,279,150 | 4/1942 | Thom | 4/148 |
| 2,466,076 | 4/1949 | Bentley et al. | 220/86 |
| 2,495,532 | 1/1950 | Leonard | 285/2 |
| 2,754,137 | 7/1956 | Gine et al. | 285/165 |
| 2,776,168 | 1/1957 | Schweda | 299/73 |
| 2,910,090 | 10/1959 | Weir | 137/625.41 |
| 3,026,898 | 3/1962 | Weller | 137/359 |
| 3,190,308 | 6/1965 | Winkle et al. | 137/359 |
| 3,192,952 | 7/1965 | Botnick | 137/607 |
| 3,532,101 | 10/1970 | Snyder | 285/318 X |
| 3,653,407 | 4/1972 | Katva | 137/615 |
| 3,680,780 | 8/1972 | Arbon | 239/26 |
| 3,779,467 | 12/1973 | Arbon | 239/587 X |
| 3,970,103 | 7/1976 | McKee | 137/357 |
| 4,099,670 | 7/1978 | Cole et al. | 285/302 X |
| 4,223,923 | 9/1980 | Hill | 285/95 |
| 4,287,915 | 9/1981 | Hoffmann et al. | 251/297 X |

*Primary Examiner*—Gerald A. Michalsky
*Assistant Examiner*—John C. Fox
*Attorney, Agent, or Firm*—Kinzer, Plyer, Dorn & McEachran

[57] ABSTRACT

A vertically adjustable faucet spout includes a base formed and adapted to seat upon a sink top, escutcheon plate or the like including a downwardly-extending guide sleeve. A vertically movable post is slidably mounted in the base and sleeve for movement relative thereto. A flexible water supply conduit is connected to the post at the lower end thereof to supply water to the assembly. A spout is positioned on the upper end of the post and is seated upon the base when the post is in the fully lowered position. The spout is rotatably movable, as a unit, and is vertically adjustable. The exterior of the post has recess means thereon and there is retaining means on the base to cooperate with the recess means to position the post, and spout in a vertically raised position relative to the base. The spout is pressure balanced whereby back pressure therein caused by flow control devices on the spout will not cause undesired vertical movement thereof.

1 Claim, 3 Drawing Figures

12
10
10a
18
20
14
16
60
60
22
24
70
30
32
46
38
66
54
32
66
54
22a
50
48
14

HIGH RISE KITCHEN SPOUT

SUMMARY OF THE INVENTION

The present invention relates to faucet spouts, particularly the type usable on a kitchen sink, although the spout construction may have utility in a lavatory or basin.

A primary purpose of the invention is a faucet spout construction in which the spout is vertically adjustable so that the user may place objects of varying size within the sink to clean them.

Another purpose is a kitchen spout construction in which the spout both rotates and is vertically movable to provide substantial flexibility in use.

Another purpose is a faucet spout construction of the type described which is pressure balanced whereby back pressure therein caused by flow restriction devices on the spout will not cause unwanted or undesired movement of the spout once it has been placed in a vertically adjusted position.

Another purpose is a simply constructed reliably operable vertically adjustable faucet spout.

Another purpose is a spout of the type described which is usable with a remote control valve.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention relates to faucets of the type customarily found in the kitchen, although the structure described may have utility in a lavatory or other type of sink. The invention is specifically concerned with a spout structure in which the spout is vertically adjustable so that the height of the spout above the sink may be varied permitting pots or pans or containers of various size to be easily washed within the sink. In the past, it was difficult to wash certain types of large containers or large cooking utensils in a sink because the faucet spout was at a fixed level above the sink. If the container would not fit under the spout the washing procedure was quite cumbersome. In the present structure, the spout is vertically adjustable so that its height above the sink may be varied. The faucet spout may be adjusted to a fixed point above the sink and although there is only one such fixed point described herein, it should be clear that there may be as many levels of height adjustment above the sink area as may be useful.

Figure 1:
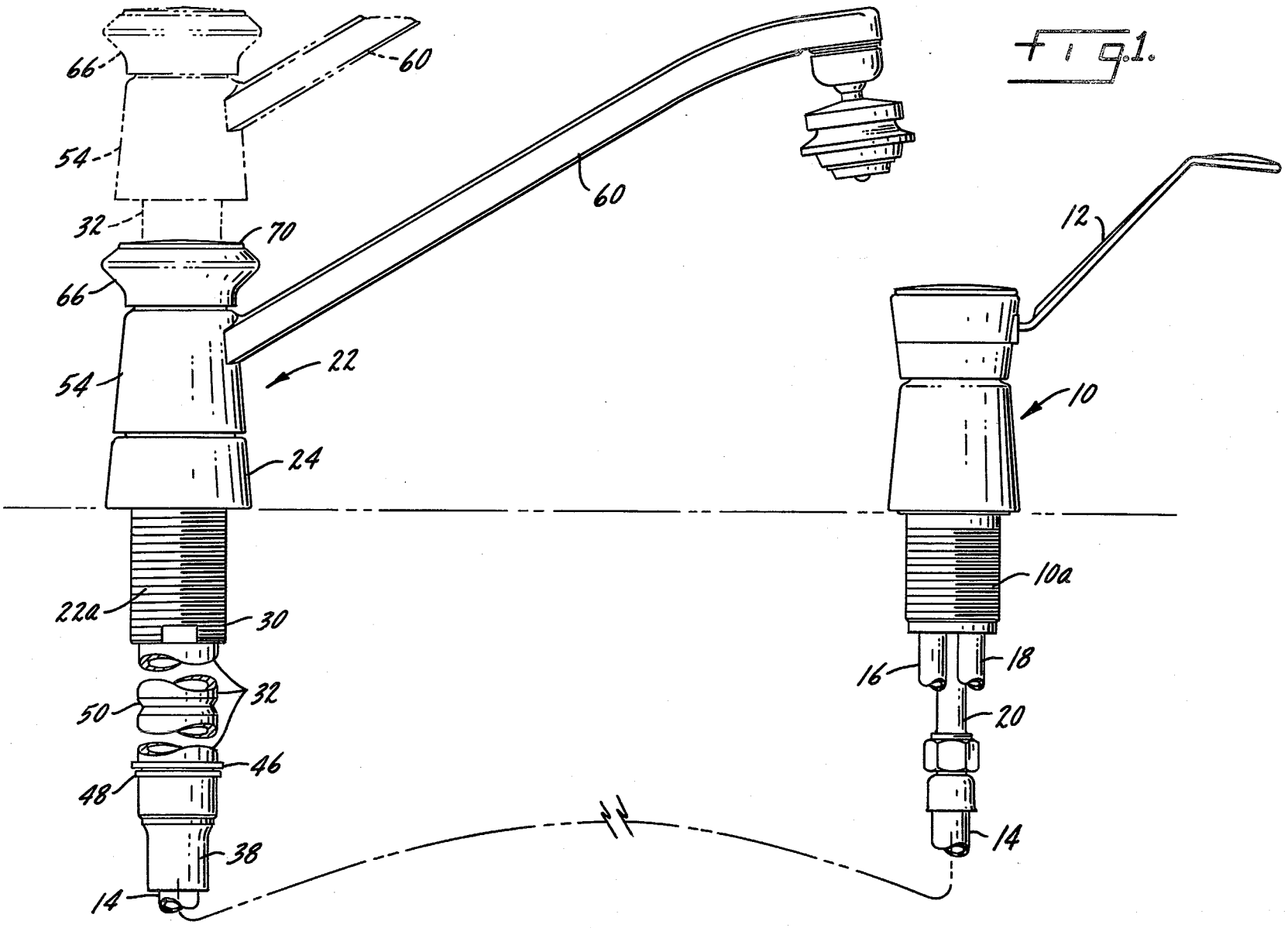
FIG. 1 is a diagrammatic illustration of the faucet spout of the present invention and the related control valve, with a raised position of the spout being indicated in broken lines.

In FIG. 1 a control valve is indicated generally at 10 and may have an operating lever 12. The control valve 10 may be a single handle mixing valve or it may be a two-handle valve arrangement. The particular type of valve used is not important or essential to the invention. Specifically, the structure illustrated in FIG. 1 may utilize a control valve of the type shown in my U.S. Pat. No. 3,840,048. In the use of a valve of that type, rotation of lever 12 is effective to vary the temperature of the water passing from the valve through a flexible hose 14 with up and down movement of the lever 12 being effective to control the volume. The hot and cold water inlets for the valve are indicated at 16 and 18 with the mixed water passing downwardly through a fixed conduit 20 connected to the flexible hose 14.

Hose 14 will be connected at the lower end of the spout structure indicated generally at 22. Both the control valve 10 and the spout structure 22 may be suitably attached to the upper surface of a sink, either by conventional escutcheon plates or by being directly attached in the sink top. For that purpose, both control valve 10 and spout structure 22 have threaded areas indicated at **10*a* and 22*a***.

Figure 2:
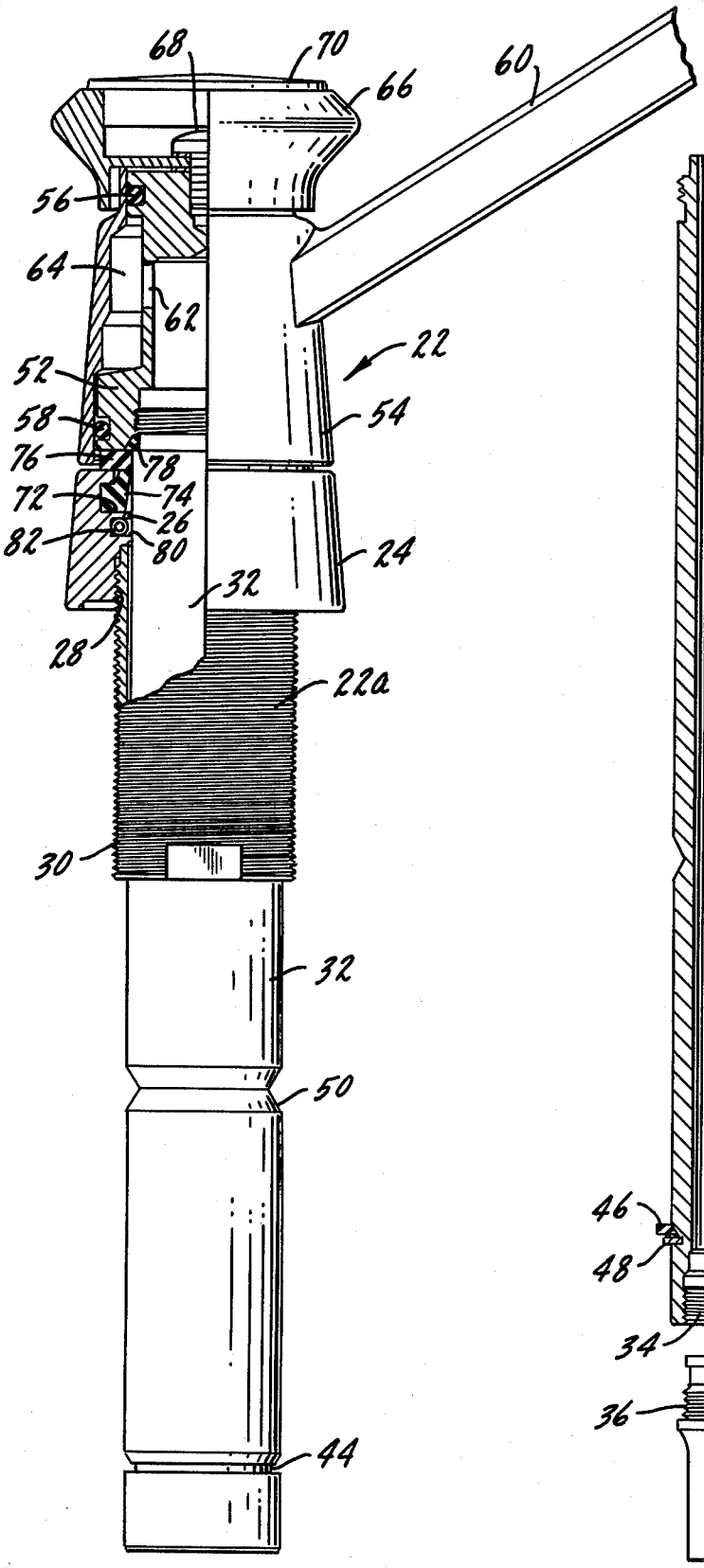
FIG. 2 is an enlarged partial vertical section illustrating the upper portion of the spout construction.
Figure 3:
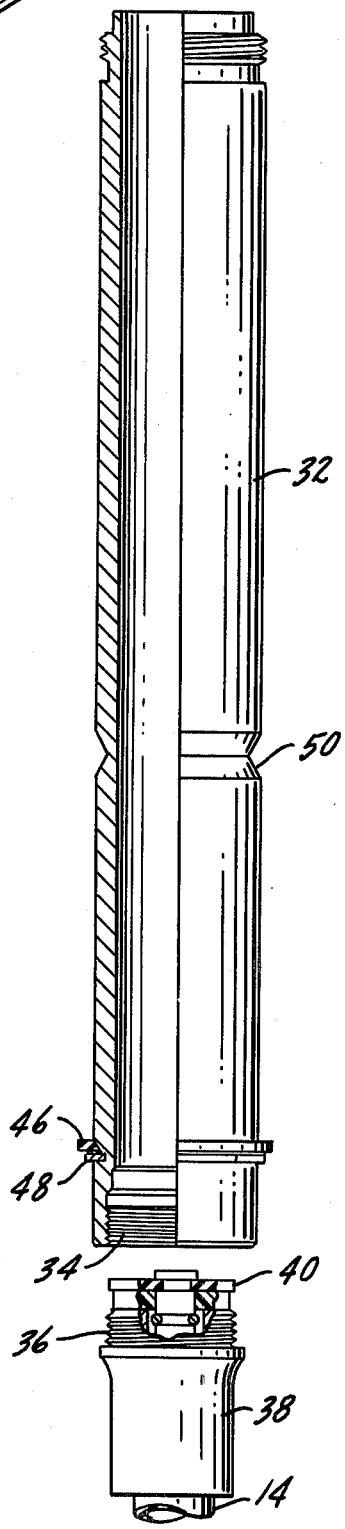
FIG. 3 is a partial vertical section illustrating the adjustable post of the spout construction of FIGS. 1 and 2.

The details of the spout structure are illustrated in FIGS. 2 and 3. A base 24 will conventionally seat upon the sink surface and has a generally central passage 26, the lower end of which is threadedly attached, as at 28, to a shank or sleeve 30. Sleeve 30 provides the exterior thread **22*a* necessary to attach the spout structure to the sink top. Mounted within sleeve 30 and within the interior passage of base 24 is a post 32, the lower end of which is attached to hose 14. Looking specifically at FIG. 3, the lower end of post 32 has an interior thread 34 which will receive the threaded end 36 of a fitting 38 which is attached to the hose. Fitting 38 may include a seal structure 40** which fits within the lower end of the post and provides a seal between the hose and the post or a fluid tight attachment of the hose to the post.

Adjacent the lower end of post 32 is an irregularly-shaped groove 44 which accommodates a bumper ring washer 46 which may be of rubber or a similar material and a retaining ring 48 which is used to securely attach bumper ring 46 to the post. Bumper ring 46 provides a stop preventing complete removal of the spout structure from base 24.

Intermediate the opposite ends of post 32 is a somewhat V-shaped recess 50 which provides for a set or predetermined vertical height adjustment. As indicated above, there may be more than one such groove or recess so that there can be various positions of vertical adjustment of the spout structure.

Post 32 extends upwardly through sleeve 30 and through base 24 and is threaded into the interior of a spout body 52. Spout body 52 is enclosed by a spout housing 54 and there may be upper and lower seal rings 56 and 58, respectively, which seal the exterior of the spout body and the interior of housing 54. Integral with housing 54 is a spout 60. Spout 60, housing 54, spout body 52 and post 32 are all suitably attached together for integral movement, both rotational to vary the location of the spout above the sink, and vertical to vary the height of the spout above the sink.

There may be one or more passages 62 which connect the interior of spout body 52 and an annular chamber 64 formed between the exterior of the spout body and the interior of housing 54. Seal rings 56 and 58 seal the opposite ends of chamber 64. Spout 60 will be in communication with chamber 64 whereby water passing upwardly through post 32 from hose 14 will flow into the spout for conventional discharge.

A knob 66 may be attached by a screw 68 to the upper end of spout body 52 and there may be a suitable cap or cover 70 covering the screw, as is conventional in faucet construction. Knob 66 will rotate and vertically move the spout body and thus rotate the entire spout assembly consisting of spout 60, spout body 52, housing 54 and post 32, as described.

Base 24 has a recess 72 within which is positioned a wiping seal 74 which bears against the exterior of post 32. Seal 74 not only provides the conventional sealing functions, but also is effective to provide a slight breaking or frictional force to slow or retard movement of the post. Positioned directly above wiping seal 74 is a bumper 76 which is positioned against the bottom of spout body 52 when the spout is in the complete lowered or down position of FIG. 2. Bumper 76 thus provides a stop preventing further downward movement of the spout structure. A small O-ring or the like 78 is positioned within a recess in the spout body and seals the junction of post 32 to the spout body, just below the threaded attachment of these two members.

A groove 80 is formed in base 24 directly beneath recess 72 accomodating wiper seal 74, with groove 80 positioning a spring 82, for example a garter spring, which cooperates with V-shaped groove 50 on post 32 to hold the post and thus the entire spout assembly in a vertically-adjustable position. When the spout assembly is moved upward, for example to the broken line position of FIG. 1, spring 82 will snap into groove 50 when the two are in register, thus providing a means for fixing the spout at a specific vertically adjusted position.

The spout structure shown herein is pressure balanced when water is applied thereto and this is important as it will prevent undesirable movement of the spout assembly. Customarily there will be some type of flow restriction device, such an aerator or the like, mounted on the end of spout 60. Such a device creates a back pressure within the water passages leading to the spout. However, because post 32 is attached directly to a flexible hose leading over to the control valve, such back pressure is accommodated and there are no internal surfaces subject to water pressure which would force or cause post 32 and its attendant spout assembly to move upwardly.

Whereas the preferred form of the invention has been shown and described herein, it should be realized that there may be many modifications, substitutions and alterations thereto.

The embodiments of the invention in which an exclusive property or privilege is claimed are defined as follows:

1. A vertically adjustable faucet spout including a base and guide sleeve for attachment to a sink top or the like, a post slidably mounted in said sleeve for vertical movement relative thereto, elastomeric bumper members positioned about the exterior of said post and effective to provide upper and lower movement limiting stops therefor, a flexible water supply conduit attached to said post at the lower end thereof, a spout assembly positioned at the upper end of said post and seated upon said base when the post is in a full lowered position, said spout assembly including a spout body attached to the upper end of said post and seated upon said base when said post is in a fully lowered position, a housing mounted upon said spout body, a sealed chamber formed within said housing and exteriorly of said spout body, passage means in said spout body in communication with said chamber, a spout integral with said housing and in communication with said chamber, said upper elastomeric bumper member being seated upon the top of said base when said post, body, housing and spout assembly are in the fully lowered position, with said lower bumper member being in contact with the lower end of said sleeve when said assembly is in the uppermost position, the exterior of said post having recess means thereon, an interior groove in said body, a retaining spring positioned in said groove to cooperate with said recess means to position said post in a vertically raised position relative to said base, a wiper seal positioned within said base and bearing against the exterior of said post, said wiper seal being positioned adjacent said retaining spring, said post being pressure balanced whereby back pressure therein caused by flow control devices will not cause vertical movement thereof.

* * * * *